US005333366A

United States Patent [19]

Guse

[11] Patent Number: 5,333,366

[45] Date of Patent: Aug. 2, 1994

[54] INSTALLATION FOR MANUFACTURE OF HOT ROLLED STEEL STRIPS

[75] Inventor: Rudolf Guse, Ratingen, Fed. Rep. of Germany

[73] Assignee: SMS Schloemann-Siemag Aktiengesellschaft, Dusseldorf, Fed. Rep. of Germany

[21] Appl. No.: 83,109

[22] Filed: Jun. 24, 1993

[30] Foreign Application Priority Data

Jun. 24, 1992 [DE] Fed. Rep. of Germany ..... 4220605

[51] Int. Cl.[5] ..... B21B 1/46; B22D 11/12

[52] U.S. Cl. ..... 29/33 C; 29/527.6; 72/202

[58] Field of Search ..... 29/33 C, 33 S, 527.1, 29/527.6, 527.7, 527.5; 164/417, 418; 72/202

[56] References Cited

U.S. PATENT DOCUMENTS

| | | | |
|---|---|---|---|
| 4,918,803 | 4/1990 | DiGiusto | 29/33 C |
| 4,942,656 | 7/1990 | Benedetti et al. | 29/527.6 |
| 5,035,036 | 7/1991 | Bohnenkamp | 29/33 C |
| 5,075,953 | 12/1991 | Braud | 29/527.7 |
| 5,115,547 | 5/1992 | Rohde | 29/33 C |
| 5,182,847 | 2/1993 | Guse | 29/33 CX |
| 5,205,342 | 4/1993 | Eichler | 164/417 |
| 5,212,856 | 5/1993 | Di Gusto et al. | 29/33 C |

FOREIGN PATENT DOCUMENTS

| | | | |
|---|---|---|---|
| 413169 | 2/1991 | European Pat. Off. | 29/33 C |
| 3741220 | 9/1989 | Fed. Rep. of Germany | 29/33 C |
| 5747501 | 3/1982 | Japan | 29/33 C |
| 1576227 | 7/1990 | U.S.S.R. | 29/527.6 |

*Primary Examiner*—William Briggs
*Attorney, Agent, or Firm*—Anderson Kill Olick & Oshinsky

[57] ABSTRACT

An installation for the manufacture of hot rolled steel strips is disclosed which reduces the constructions costs, energy expenditure and space consumed. The installation comprises at least two thin slab casters, arrangements for preheating and/or keeping the thin slabs at a particular temperature and a hot finishing rolling train. Two thin slab casters 1 and 2 are disposed to face each other and have opposite billet output conveyance, with a cut-to-length line 20, 21, a two-high furnace 22, 23 with superimposed roller tables 27, 28 and a transfer furnace 24, 25 with a roller table 34. The height of the roller table is adjustable to match the superimposed roller tables 27, 28 of the two-high furnace 22, 23 and is located downstream of each thin slab caster 1, 2. Lower roller tables 28 of the two-high furnaces 22, 23 are interconnected by an intermediate roller table 32, extending beneath the continuous casters 1, 2 and are connected with the rolling mill feed roller table 6 by a roller table 34 of an adjustable height transfer furnace 33.

8 Claims, 3 Drawing Sheets

INSTALLATION FOR MANUFACTURE OF HOT ROLLED STEEL STRIPS

FIELD OF THE INVENTION

The present invention is directed to an installation for the manufacture of hot rolled steel strips having at least two thin slab casters, an apparatus for reheating and/or holding the thin slabs at a particular temperature and a hot finishing rolling train.

BACKGROUND OF THE INVENTION

DE-A1 39 27 189 discloses the furnace roller tracks of two continuous casting installations connected with a central rolling mill feeding roller table by a heated ferry for lateral transport of the thin slabs. This installation requires a relatively large area and is of a relatively expensive design.

It is therefore an object of the invention to create an installation for the manufacture of hot rolled steel strips having lower surface requirements.

Another object of the invention is to create an installation for the manufacture of hot rolled steel strips having lower construction and energy costs.

Still another object of the invention is to provide an installation for the manufacture of hot rolled steel strips which can satisfactorily handle emergency situations.

SUMMARY OF THE INVENTION

These and other objects of the invention, which shall become hereafter apparent, are achieved by an installation for the manufacture of hot rolled steel in which two thin slab casters are facing each other and having opposite output of continuously cast billets. A cut-to-length line, a two-high furnace with superimposed roller tables or beds and a transfer furnace with a roller table, adjustable to the superimposed roller tables of the two-high furnace are disposed downstream of each thin slab caster. The bottom roller tables of the two-high furnaces are interconnected by a roller table extending below the continuous caster and are connected with the rolling mill feed roller table by an adjustable height roller table of a transfer furnace.

The opposed facing arrangement of the two thin slab casters saves considerable expense since the two continuous casters are charged with steel melts by one only ladle and an intermediate container. The saved ladles and intermediate containers helps eliminate their transport means, maintenance stations and heating stations.

The inventive use of two-high furnaces and transfer furnaces, with short vertical stroke in the reheat and holding at temperature region of the installation, helps save design expenses, workshop floor space, and foundation costs. A two-high furnace consists advantageously of a heated chamber where two roller tables are superimposed to be spaced from each other. The rollers of the roller tables are supported and driven externally to the chamber.

A transfer furnace is configured as a stationary heated chamber, where the adjustable height roller table is disposed. The roller bearings of the roller table are fastened on bearing carriers disposed outside of the chamber and are provided with an elevation drive. The chamber comprises lengthened side and pass-through openings, matching the vertical stroke of the rollers. Mobile covers are fastened at the side walls of the furnace chamber for the respective exposed regions of the pass-through apertures. The rollers of the roller table are driven by one motor, each through their trunnions.

Alternatively, a transfer furnace can consist of a heated chamber provided with an elevation drive and a roller table located inside it.

BRIEF DESCRIPTION OF THE DRAWINGS

The invention will be better understood with reference to the Detailed Description of the Preferred Embodiment, in connection with the drawings, of which.

DETAILED DESCRIPTION OF THE PREFERRED EMBODIMENT

Figure 1:
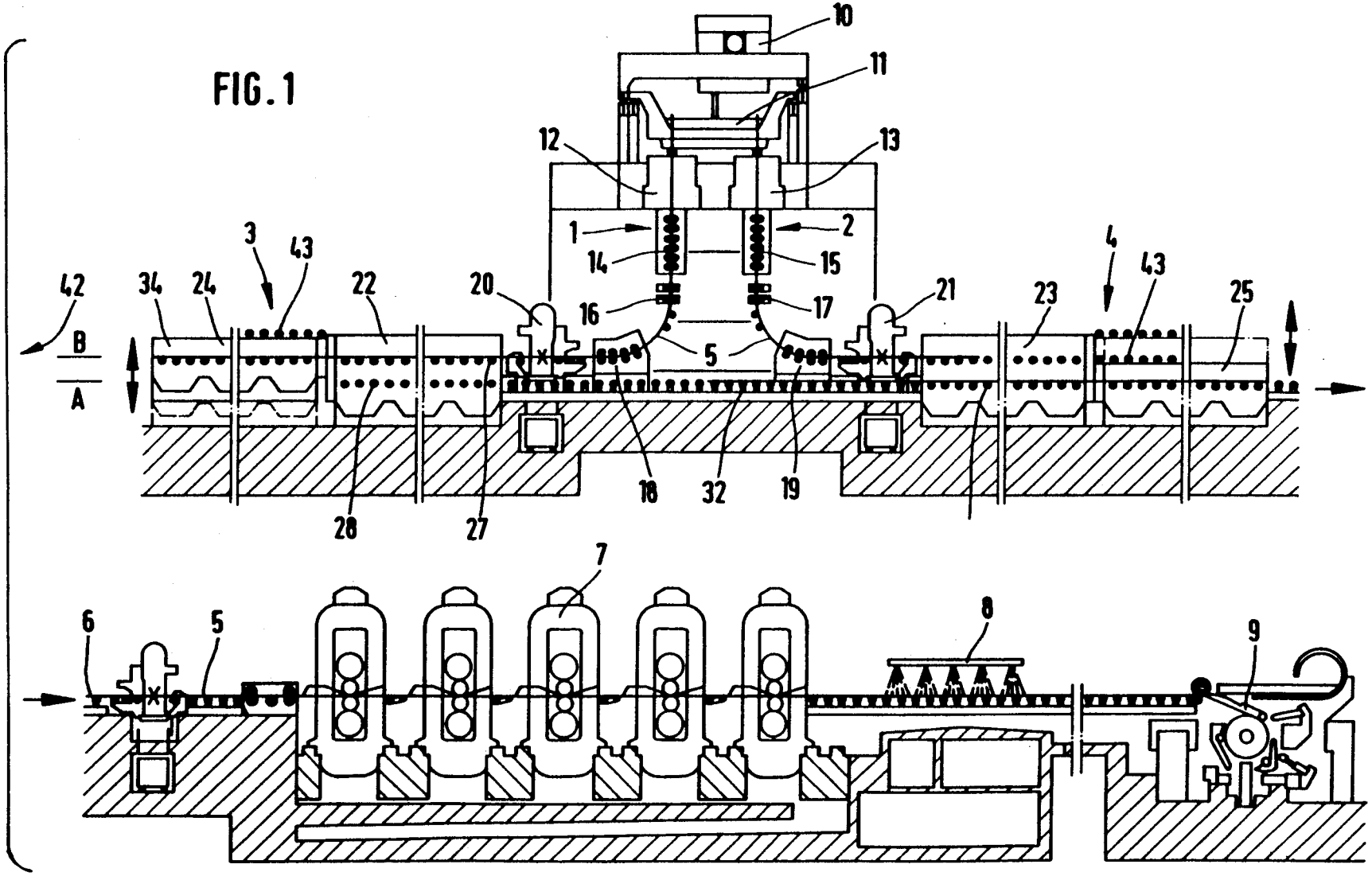
FIG. 1 depicts, in cross-sectional view, an installation for the manufacture of hot rolled steel strips.

Reviewing now the drawings, wherein the numerals represent like elements throughout the several views, an installation for the manufacture of hot rolled steel strips is shown in FIG. 1, comprising two thin slab casters 1, 2, arrangements 3, 4 for reheating the thin slab segments 5 and holding the same at a particular temperature, a feed roller table 6, a hot finishing rolling train 7, a cooling distance 8 and a coiler 9.

The thin ingot casters 1, 2, which are facing each other and have opposite output conveyance directions are charged with steel melt from a ladle 10 through a common intermediate container 11. The thin slabs formed in an ingots mold 12, 14 pass through one slab guide 14, 15 and are bent onto a circular track by bending rolls 16, 17. Subsequently, the thin slabs 5 are straightened or aligned in one pinch roller arrangement 18, 19 and are subdivided by, respectively, one shears 20, 21 into segments.

Figure 2:
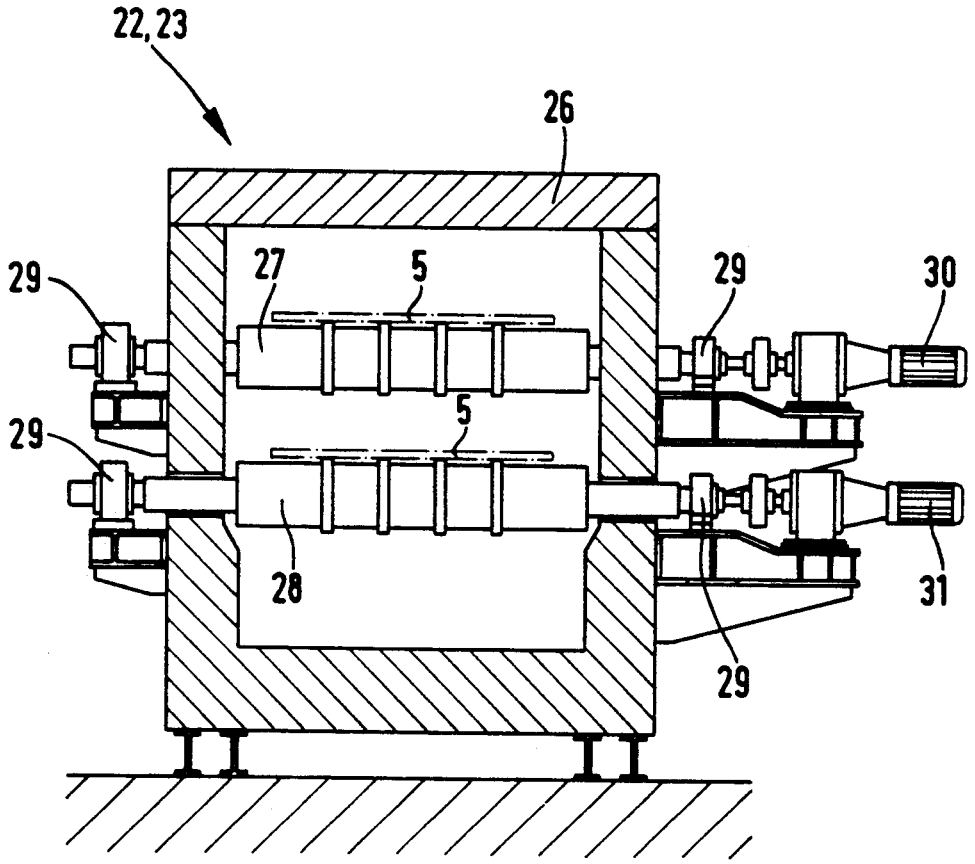
FIG. 2 depicts a cross-section view of a two-high roller hearth furnace.
Figure 3:
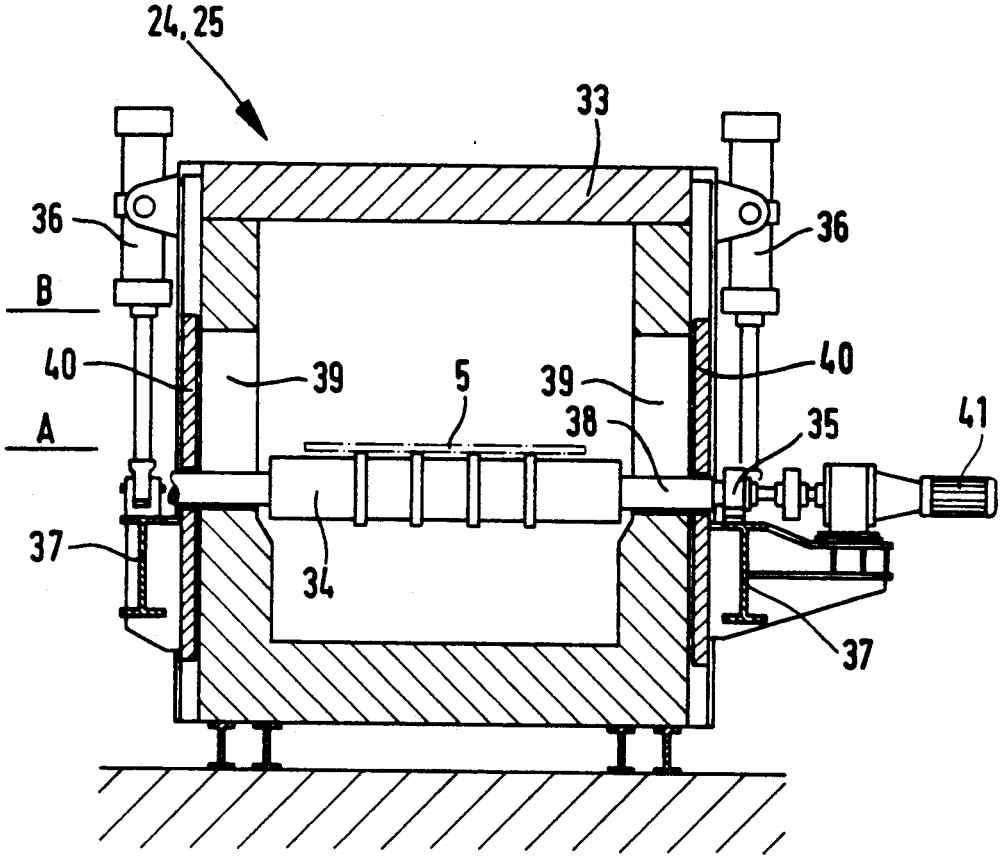
FIG. 3 is a cross-sectional view through a transfer furnace.

The arrangements 3,4 for reheating the thin slab segments 5 and holding the same at a particular temperature, located downstream of each thin slab caster 1, 2, comprises one each two-high furnace 22, 23 and one each transfer furnace 24, 25. The two-high furnaces 22, 23 comprise an upper roller table 27 in a chamber 26 and a lower roller table 28 and roller bearings 29 located outside the chamber 26 (see FIG. 2). The rollers of the top and bottom roller table 27, 28 are driven by motors 30, 31. The lower roller tables 28 are connected by an intermediate roller table 32 which can be covered.

Each height adjustable roller table 34, adjustable to the conveyance plane A and B of the upper and lower roller tables 27, 28 of the associated two-high furnace 22 or 23, are located in the heated chamber 33 of the transfer furnaces 24, 25. For this purpose, bearings of the height adjustable roller tables 34 are disposed at a tie bar 37 provided with an elevating drive 36 and located externally of the furnace chambers 33. Passage or through apertures 39 in the side walls of the furnace chambers 33, provided for the trunnions 38 of the roller table rollers, are shaped to be rounded oblong, corresponding to the vertical stroke. The respective exposed regions of the pass-through apertures 39 can be closed by mobile covers 40. The roller trunnions 38 are driven by motors 41.

An emergency run-out roller table 42 is located downstream of the transfer furnace 24 of a continuous caster 1.

A deposit area roller table 43 for the entry slabs of the continuous casters 1 and 2 is disposed on every chamber 33 of the transfer furnaces 24, 25.

while the preferred embodiment of the invention has been disclosed in detail, modification and adaptation may be made thereto, without departing from the spirit and scope of the invention, as recited in the following claims:

What is claimed is:

1. An installation for the manufacture of hot rolled steel strips, comprising:

a hot finishing rolling train having a feed roller table;

two thin slab casters facing each other and having opposite thin slab conveyances;

two cutter arrangements located each downstream of a respective thin slab caster;

a two-high furnaces having each superimposed roller tables and each being located downstream of a respective cutter arrangement;

two transfer furnaces located each downstream of a respective two-high furnace and having each a height-adjustable roller table adjustable to a height of one of the superimposed roller table of the respective two-high furnace; and an intermediate roller table extending beneath said two thin slab casters for connecting lower roller tables of the two two-high furnaces, the lower roller tables of the two-high furnaces being connected with the feed roller table of the hot finishing roller train by the height-adjustable roller table of one of the transfer furnaces.

2. The installation of claim 1, wherein each two-high furnace comprises a housing defining a heated chamber in which the superimposed tables are located, and means located outside of the housing for supporting and driving rollers of the superimposed tables.

3. The installation of claim 1, wherein each transfer furnace comprises:

a stationary heated chamber in which the height-adjustable table is located; and tie bars located externally of the heated chamber for supporting drive rollers of the height-adjustable table and provided each with an elevation drive for height adjusting the rollers, said heated chamber having side through-passage openings for accommodating a vertical stroke of trunnions of the height-adjustable roller table.

4. The installation of claim 3, wherein each transfer furnace further comprises cover means for covering the side through-passage openings.

5. The installation of claim 3, wherein each transfer furnace comprises a chamber having an inner space in which the height-adjustable roller table is located and elevation drive for height adjusting the roller table.

6. The installation of claim 1, further comprising an emergency runout roller table located downstream of the transfer furnace of one of the thin slab caster.

7. The installation of claim 5, further comprising a deposit roller table arranged on the heated chamber for slabs initially fed from a respective thin slab caster.

8. The installation of claim 1, wherein the intermediate table has a top covering.

* * * * *